US011525647B2

(12) United States Patent
Geissele et al.

(10) Patent No.: US 11,525,647 B2
(45) Date of Patent: Dec. 13, 2022

(54) FIREARM BARREL FEEDING GEOMETRY

(71) Applicant: WHG PROPERTIES, LLC, North Wales, PA (US)

(72) Inventors: William H. Geissele, Lower Gwynedd, PA (US); Frank Robinson, Schwenksville, PA (US); Matt Sibio, York Haven, PA (US)

(73) Assignee: WHG Properties, LLC, North Wales, PA (US)

( * ) Notice: Subject to any disclaimer, the term of this patent is extended or adjusted under 35 U.S.C. 154(b) by 10 days.

(21) Appl. No.: 17/172,710

(22) Filed: Feb. 10, 2021

(65) Prior Publication Data

US 2022/0252369 A1 Aug. 11, 2022

(51) Int. Cl.
*F41A 21/12* (2006.01)
*F41A 21/48* (2006.01)

(52) U.S. Cl.
CPC ..... *F41A 21/12* (2013.01); *F41A 21/482* (2013.01)

(58) Field of Classification Search
CPC ..... F41A 21/12; F41A 21/482; F41A 21/481; F41A 3/30; F41A 3/16; F41A 3/36
See application file for complete search history.

(56) References Cited

U.S. PATENT DOCUMENTS 2,655,837 A * 10/1953 Johnson ..... F41A 9/29 42/25
5,351,598 A * 10/1994 Schuetz ..... F41A 5/18 89/185
6,182,389 B1 * 2/2001 Lewis ..... F41A 3/26 89/185
9,234,713 B1 * 1/2016 Olson ..... F41A 9/41
9,383,154 B2 * 7/2016 Stone ..... F41A 21/28
9,448,020 B1 * 9/2016 Olson ..... F41A 3/66
10,215,518 B1 * 2/2019 Kramer ..... F41A 15/14
11,092,396 B1 * 8/2021 Sugg ..... F41A 9/55

OTHER PUBLICATIONS

Feed Ramps Comparison, AR15 barrels.com, The Wayback Machine [retrieved from Internet Jul. 15, 2021], https://web.archive.org/web/20110610042714/http://www.ar15barrels.com/gfx/feedramps.jpg (2 pages).

LRB Arms Genuine Forged M14 Rifles & Parts, *How To Build An M14/M1A Rifle*, The Wayback Machine [retrieved from Internet Jul. 15, 2021] https://web.archive.org/web/20180315104900/http://www.lrbarms.com:80/how-we-build-our-rifles.html (6 pages).

* cited by examiner

*Primary Examiner* — Jonathan C Weber
(74) *Attorney, Agent, or Firm* — Alston & Bird LLP

(57) ABSTRACT

Provided are barrels, barrel assemblies, firearms, and associated components, assemblies, and methods. A barrel of a firearm may include an inner surface defining a bore configured to guide a projectile as the projectile is propelled through the bore by pressurized gas. The barrel may define a muzzle end, a chamber end opposite the muzzle end, and a longitudinal axis extending between the muzzle end and the chamber end. The inner surface may define a chamber at the chamber end of the barrel. The chamber may receive a cartridge and to support at least a portion of a casing of the cartridge during firing. The barrel may further define one or more barrel feed ramps at the chamber end configured to guide at least a portion of the cartridge into the chamber during an operational cycle of the firearm. The barrel may engage with a barrel extension as a barrel assembly.

23 Claims, 8 Drawing Sheets

FIREARM BARREL FEEDING GEOMETRY

TECHNOLOGICAL FIELD

Example embodiments relate generally to feeding geometries for firearm barrel assemblies, firearm barrels that support and position a cartridge, and associated assemblies, components, and methods.

BACKGROUND

Tactical rifles and other types of firearms may be equipped with a barrel that includes a chamber for holding a cartridge during operation of the firearm. A magazine contains the cartridges that are fed from the magazine to the chamber during operational cycles. Actuation of the operational cycle of the firearm may be performed manually by an operator (e.g., a bolt action rifles) or by way of an autoloading action (e.g., automatic or semi-automatic rifles), such as a high pressure propellant gas.

The firearm may integrate the barrel into a barrel assembly with a barrel extension attached to the rear of the barrel that defines lugs for engaging the lugs of the firearm bolt. Barrels and barrel assemblies can cause misfires and jams if their geometries are not sufficiently tolerant to permit consistent feeding, and barrels and barrel assemblies having overly accommodating geometries for feeding may suffer from weakness around the chamber and make likewise suffer reliability issues. Through applied effort, ingenuity, and innovation, many of these identified problems have been solved by developing solutions that are included in embodiments of the present invention, many examples of which are described in detail herein.

BRIEF SUMMARY

The present disclosure generally relates to barrel assemblies and configurations that at least support, guide, or position a cartridge during a firearm's operational cycle.

According to some aspects of the present disclosure, there is provided a barrel assembly of a firearm. The barrel assembly may comprise a barrel. The barrel assembly may comprise a barrel extension configured to attach to the barrel. The barrel may comprise an inner surface defining a bore configured to guide a projectile as the projectile is propelled through the bore by pressurized gas. The barrel may define a muzzle end and/or a chamber end opposite the muzzle end. The inner surface may define a chamber at the chamber end. The chamber may be configured to receive a cartridge and/or to support at least a portion of a casing of the cartridge during firing. The barrel may define a longitudinal axis extending between the muzzle end and the chamber end. The barrel may define one or more barrel feed ramps at the chamber end configured to guide at least a portion of the cartridge into the chamber during an operational cycle of the firearm.

In some embodiments, the barrel may define a barrel extension interface comprising one or more engagement features, and wherein the barrel extension defines a complementary barrel extension interface comprising one or more complementary engagement features.

In some embodiments, the one or more engagement features and the one or more complementary engagement features interface to securely engage the barrel and the barrel extension.

In some embodiments, the barrel further defines a chamber end surface defining an end of the barrel at the chamber end, the chamber end surface being connected to the inner surface of the barrel via a transition. In some embodiments, the one or more barrel feed ramps are formed in the chamber end surface and the inner surface of the barrel at the chamber end.

In some embodiments, the one or more barrel feed ramps define at least one recess formed at least at the transition between the chamber end surface and the inner surface of the barrel.

In some embodiments, the one or more barrel feed ramps extends axially into the chamber farther from the chamber end surface than the transition in at least one other circumferential position that lacks the one or more barrel feed ramps, such that the one or more barrel feed ramps define a more gradual transition from the chamber end surface to the inner surface at the chamber than the transition at the at least one other circumferential position.

In some embodiments, at least one of the one or more barrel feed ramps extends radially farther from the longitudinal axis of the barrel along the chamber end surface than the transition in at least one other circumferential position that lacks the one or more barrel feed ramps.

In some embodiments, the chamber end surface is perpendicular or substantially perpendicular to the inner surface at the chamber, and wherein the transition between the chamber end surface and the inner surface of the barrel defines a substantially right angle at circumferential positions other than circumferential positions of the one or more feed ramps.

In some embodiments, the transition is circumferentially asymmetrical such that the chamber is configured to provide a greater axial length of contact with the cartridge at circumferential positions that do not include the one or more barrel feed ramps than at circumferential positions that include the one or more barrel feed ramps.

In some embodiments, the inner surface of the chamber extends farther rearward towards the chamber end surface at the circumferential positions that do not include the one or more barrel feed ramps than at the circumferential positions that include the one or more barrel feed ramps.

In some embodiments, a wall of the barrel is thinner in at least a location of the one or more barrel feed ramps than in other locations at the chamber end.

In some embodiments, each of the one or more barrel feed ramps define a semicylindrical contour oriented at an angle relative to the longitudinal axis.

In some embodiments, the one or more barrel feed ramps define at least one intermediate angle between an angle of the chamber end surface and the longitudinal axis of the barrel relative to a plane defined in part by the longitudinal axis.

In some embodiments, the one or more barrel feed ramps comprises a plurality of barrel feed ramps, and wherein each barrel feed ramp of the plurality of barrel feed ramps is oriented at least partially towards the longitudinal axis of the barrel and at least partially towards the muzzle end.

In some embodiments, the plurality of barrel feed ramps comprises two barrel feed ramps, and wherein each barrel feed ramp is angled towards a plane defined between the two barrel feed ramps, and wherein the plane is defined in part by the longitudinal axis.

In some embodiments, a first barrel feed ramp and a second barrel feed ramp are positioned adjacent to each other to engage staggered cartridges from within a magazine that are fed from alternating sides of the magazine, such that the first barrel feed ramp and the second barrel feed ramp are configured to alternatingly engage the staggered cartridges.

In some embodiments, the one or more barrel feed ramps are manufactured by removing material from the barrel.

In some embodiments, the barrel extension comprises one or more locking lugs.

In some embodiments, one or more barrel extension feed ramps configured to align circumferentially relative to the one or more barrel feed ramps.

In some embodiments, the barrel comprises two feed ramps, and the barrel extension comprises two barrel extension feed ramps.

According to another aspects of the present disclosure, there is provided a firearm. The firearm may comprise a barrel assembly. The barrel assembly may comprise a barrel and a barrel extension configured to attach to the barrel. The barrel may comprise an inner surface defining a bore configured to guide a projectile as the projectile is propelled through the bore by pressurized gas. The barrel may define a muzzle end and/or a chamber end opposite the muzzle end. The inner surface may define a chamber at the chamber end. The chamber may be configured to receive a cartridge and to support at least a portion of a casing of the cartridge during firing. The barrel may define a longitudinal axis extending between the muzzle end and the chamber end. The barrel may define one or more barrel feed ramps at the chamber end configured to guide at least a portion of the cartridge into the chamber during an operational cycle of the firearm.

In some embodiments, the firearm may comprise a bolt defining one or more bolt lugs. The firearm may comprise a bolt carrier group comprising a bolt carrier, a firing pin, and an ejector. The firearm may comprise a trigger assembly comprising a trigger, a hammer, and a disconnector. The firearm may further comprise one or more other firearm components, including without limitation one or more of a stock, a trigger guard, a pistol grip, a heat shield, a barrel shroud, an upper receiver, a lower receiver, various hardware components (e.g., screws, pins, springs, clips, and other types of hardware fasteners known in the art), and other firearm components known to one of ordinary skill in the art. The trigger assembly may be configured for automatic, burst, and/or semi-automatic operations.

According to another aspects of the present disclosure, there is provided a method of manufacturing at least a portion of a barrel assembly of a firearm. The barrel assembly may comprise a barrel and a barrel extension. The barrel may comprise an inner surface. The inner surface may define a bore configured to guide a projectile as the projectile is propelled through the bore by pressurized gas. The barrel may define a muzzle end and a chamber end opposite the muzzle end. The inner surface may define a chamber at the chamber end. The chamber may be configured to receive a cartridge and/or to support at least a portion of a casing of the cartridge during firing. The barrel may define a longitudinal axis extending between the muzzle end and the chamber end. The method may comprise attaching the barrel to a barrel extension. The method may comprise removing material from at least the barrel to define one or more barrel feed ramps at the chamber end while the barrel and barrel extension are attached. The barrel may define one or more barrel feed ramps at the chamber end configured to guide at least a portion of the cartridge into the chamber during an operational cycle of the firearm.

In some embodiments, the method of manufacture may comprise connecting, directly or indirectly, the barrel assembly with a plurality of other firearm components, including but not limited to connecting the barrel assembly directly or indirectly with at least a bolt carrier group, a trigger assembly, a receiver assembly, and a gas delivery system.

A variety of additional aspects are also described in the following detailed description and in the attached claims. The aspects can relate to individual features and to combinations of features. It is to be understood that both the foregoing general description and the following detailed description are exemplary and explanatory only and are not restrictive of the broader inventive concepts upon which the example embodiments disclosed herein are based.

BRIEF DESCRIPTION OF THE DRAWINGS

Having thus described embodiments of the disclosure in general terms, reference will now be made to the accompanying drawings, which are not necessarily drawn to scale. The following drawings are illustrative of particular embodiments of the present disclosure and do not limit the scope of the present disclosure. Moreover, the drawings are intended for use in conjunction with the explanations provided herein. Example embodiments of the present disclosure will hereinafter be described in conjunction with the appended drawings.

Figure 1:
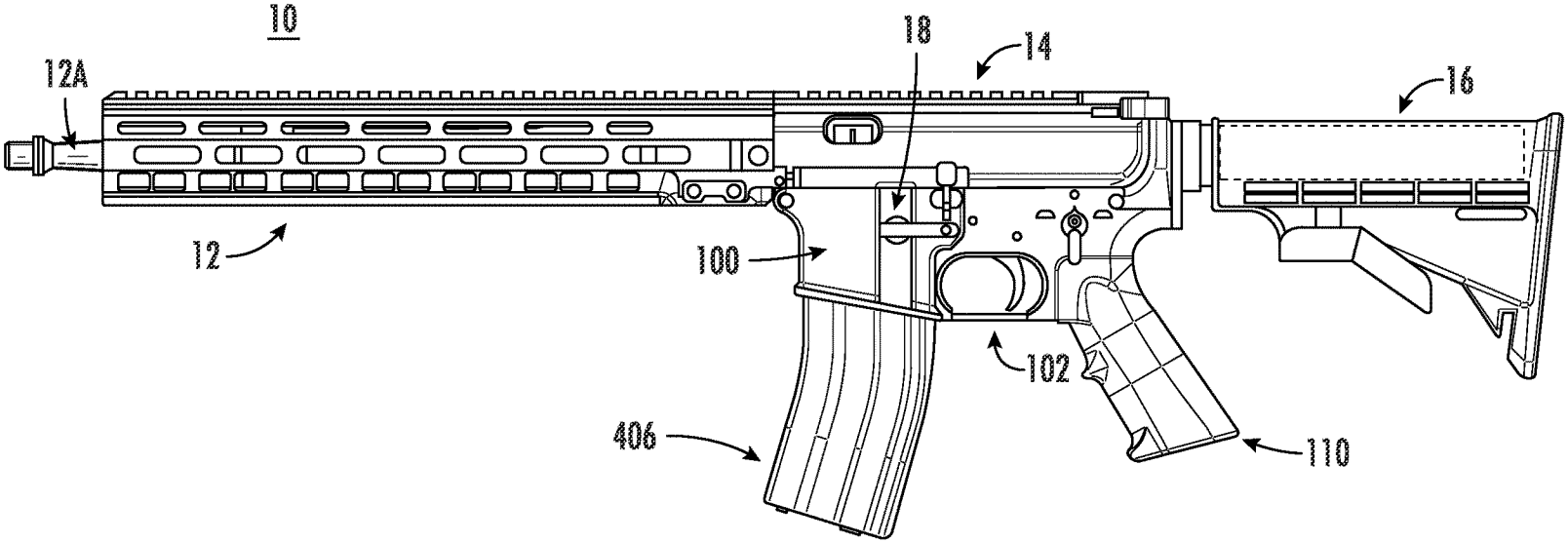

FIG. 1 is a side view of a firearm according to some example embodiments.

Figure 2:
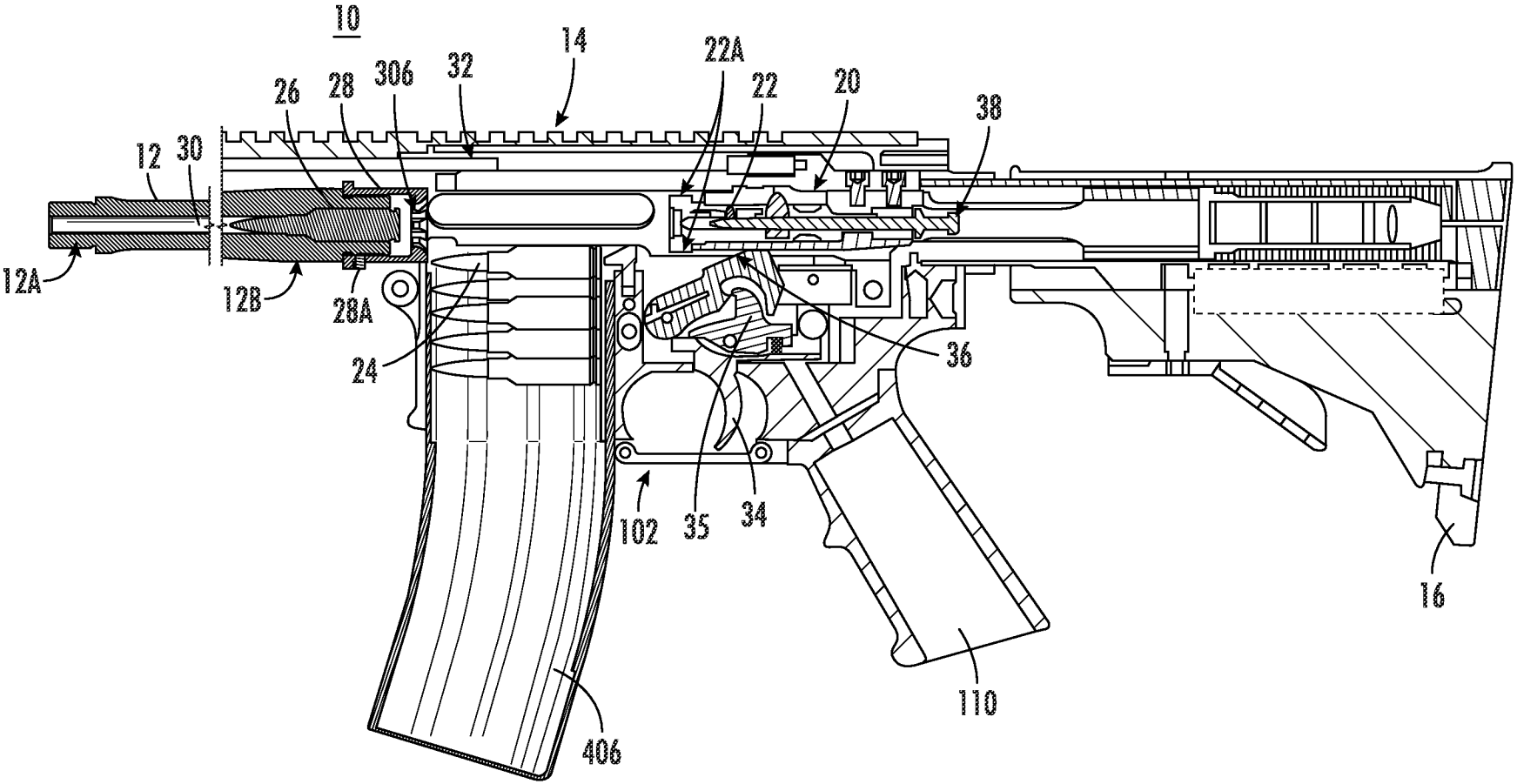

FIG. 2 is a cross-sectional view of a portion of a firearm according to some example embodiments.

Figure 3:
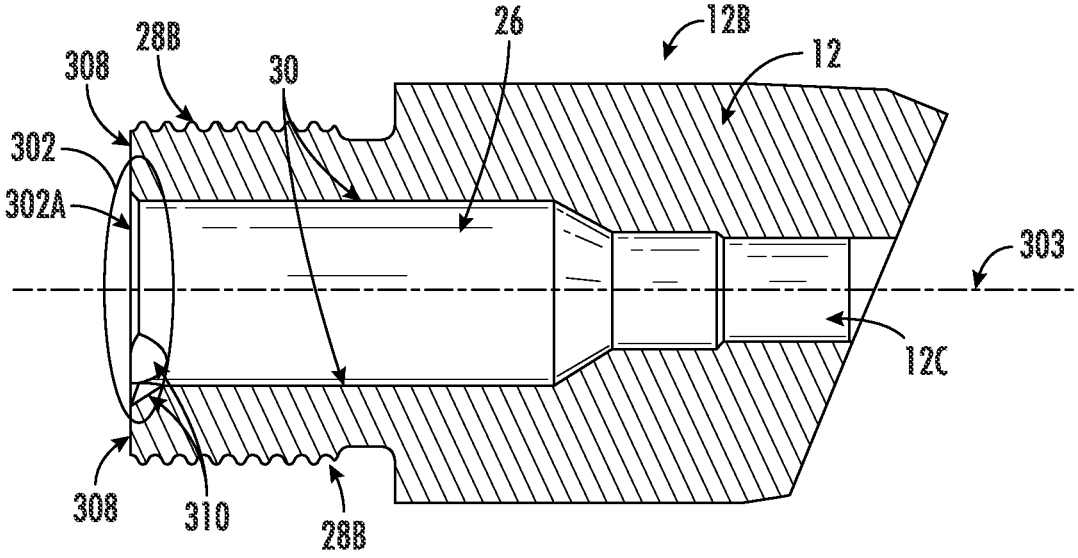

FIG. 3 is a cross-sectional view of a portion of a barrel according to some example embodiments.

Figure 4A:
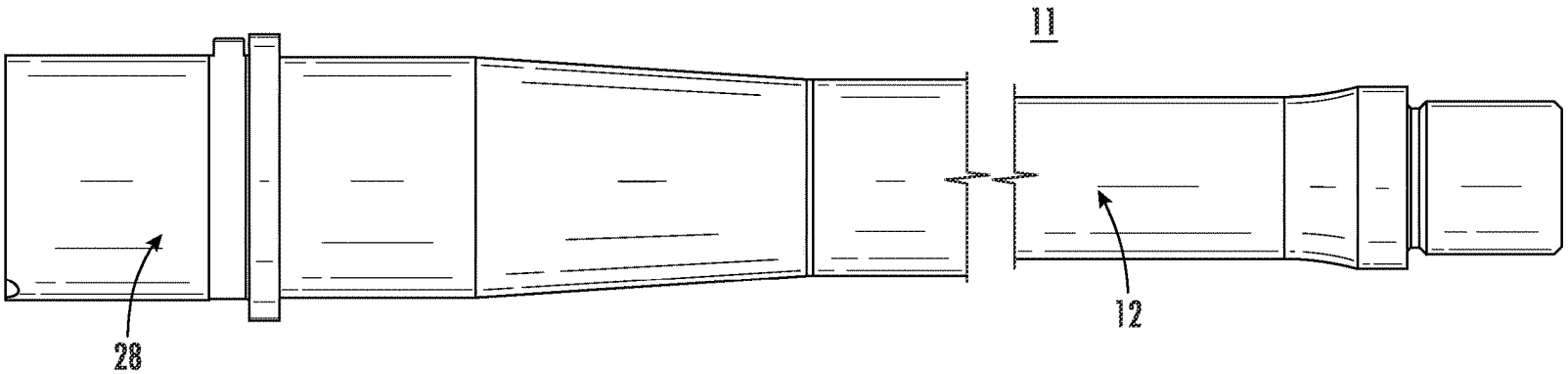

FIG. 4A is a side view of a barrel assembly according to some example embodiments.

Figure 4B:
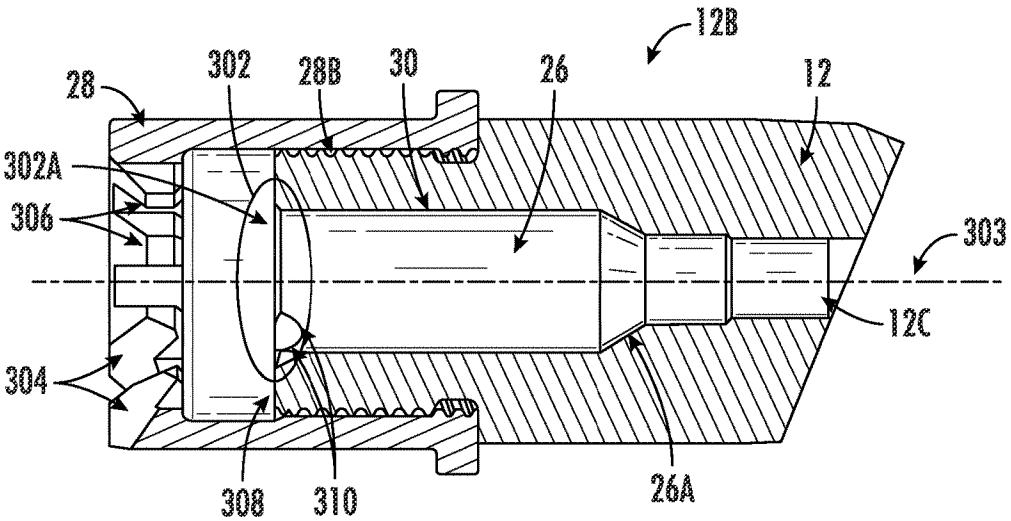

FIG. 4B is a cross-sectional view of a portion of the barrel assembly of FIG. 4A.

Figure 5B:
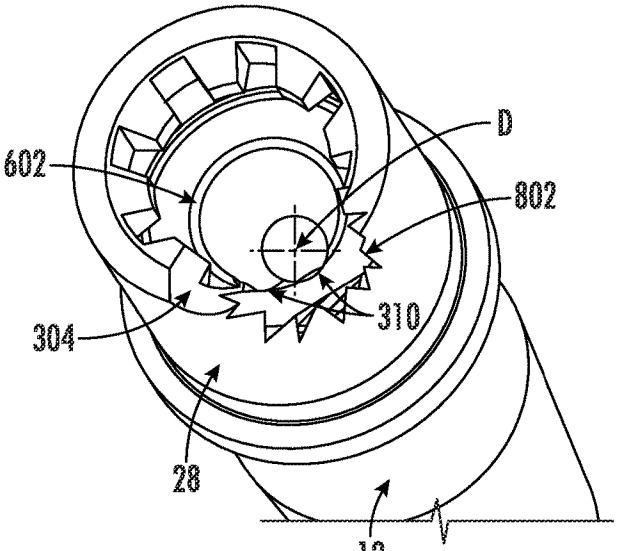
Figure 5C:
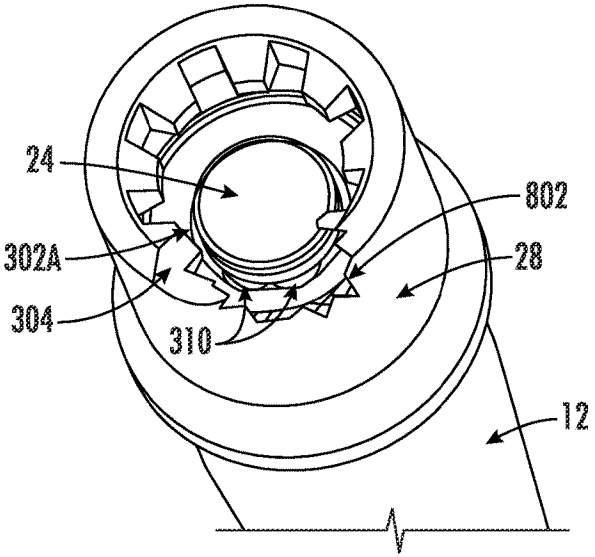
Figure 5A:
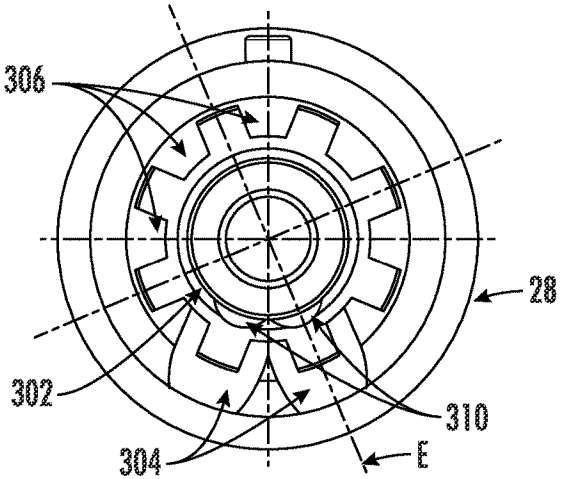

FIG. 5A is an end view of the barrel assembly of FIG. 4A taken from the chamber end.

FIG. 5B is a side isometric view of the barrel assembly of FIG. 4A.

FIG. 5C is a side isometric view of the barrel assembly of FIG. 4A.

Figure 6A:
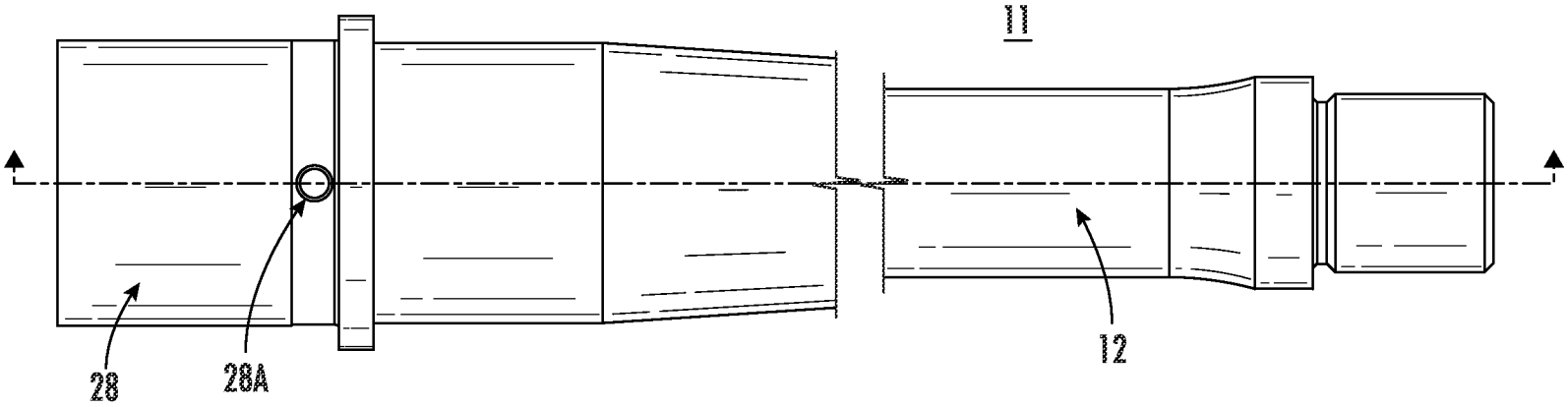

FIG. 6A is a top-down view of the barrel assembly of FIG. 4A.

Figure 6B:
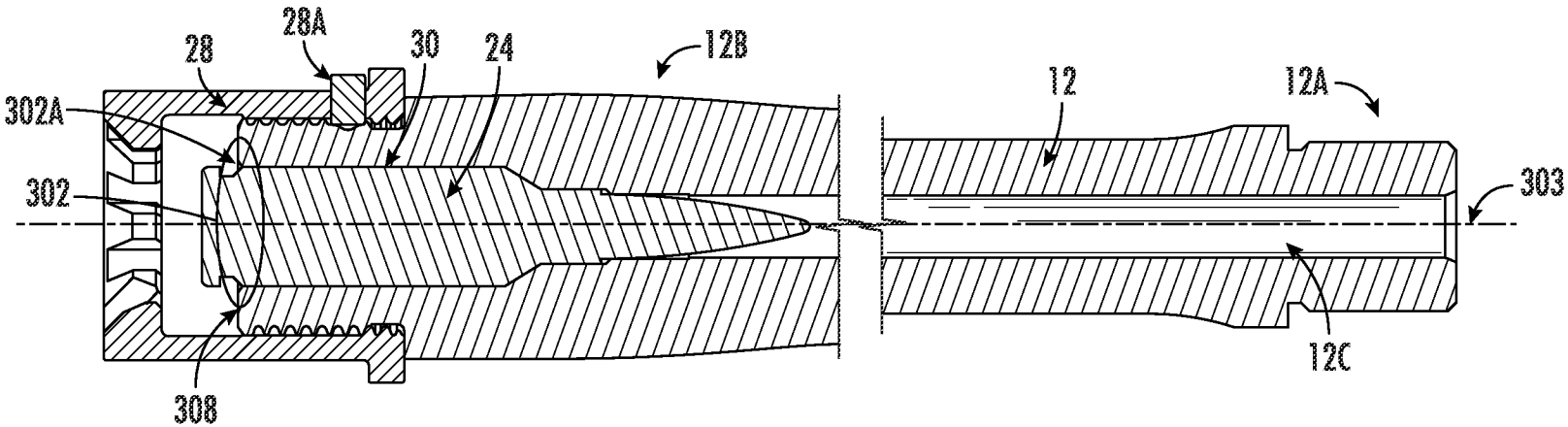

FIG. 6B is a side cross-sectional view of a portion of the barrel assembly of FIG. 4A.

Figure 7A:
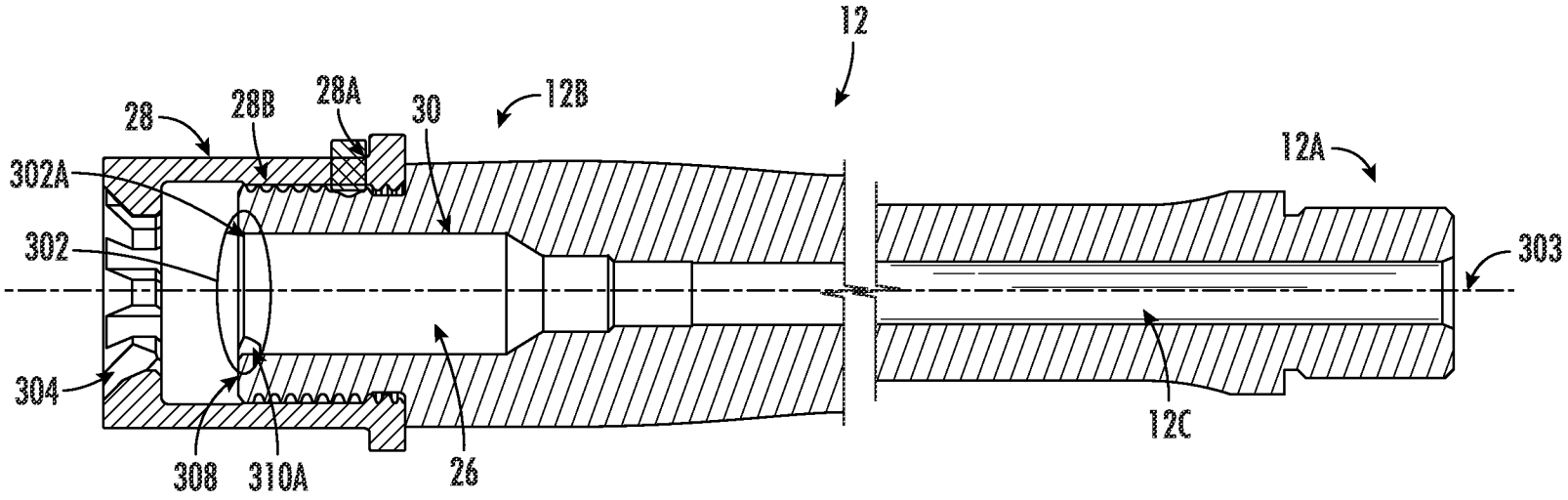

FIG. 7A is a cross-sectional view of a barrel assembly according to some embodiments.

Figure 7C:
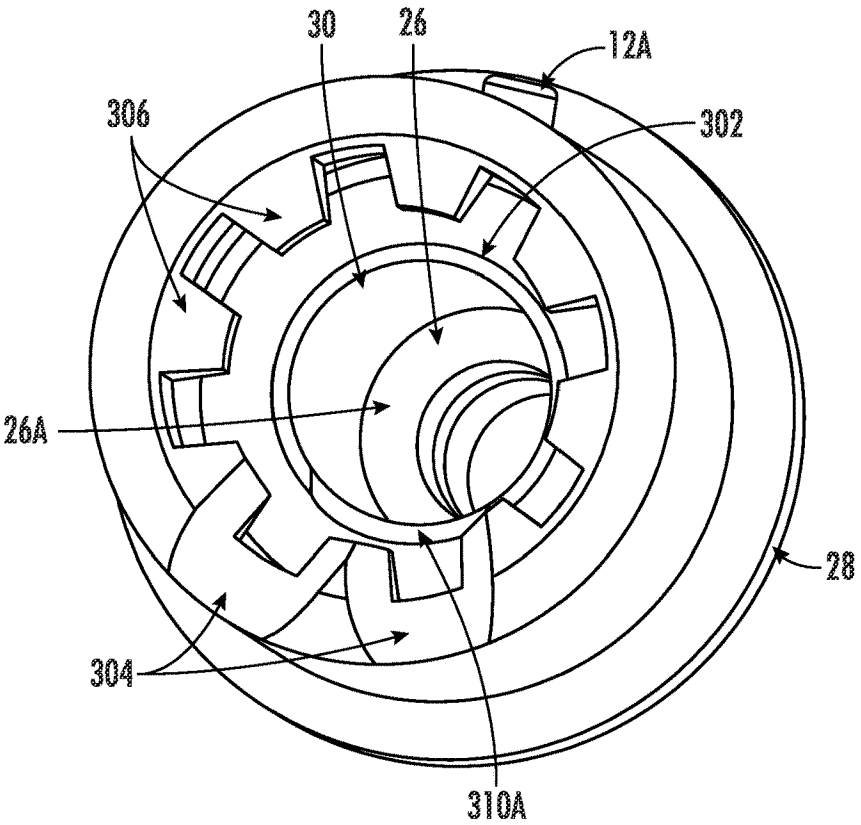
Figure 7B:
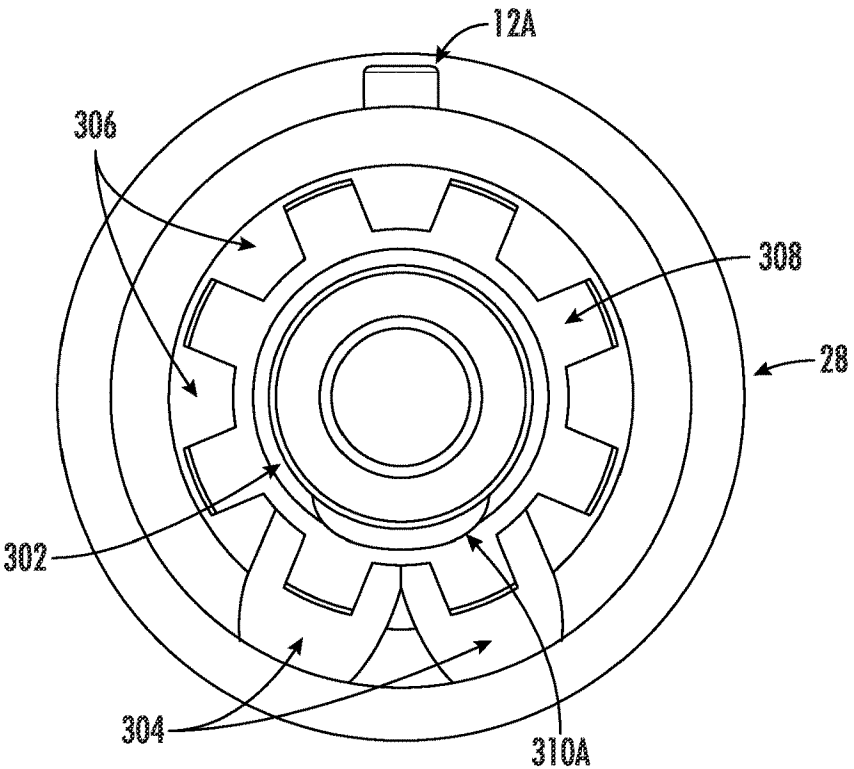

FIG. 7B is an end view of the barrel assembly of FIG. 7A taken from the chamber end.

FIG. 7C is a side isometric view of the barrel assembly of FIG. 7A.

DETAILED DESCRIPTION

Some embodiments of the present invention will now be described more fully hereinafter with reference to the accompanying drawings, in which some, but not all, embodiments of the invention are shown. Like reference numerals refer to like elements throughout. Indeed, various embodiments of the invention may be embodied in many different forms and should not be construed as limited to the embodiments set forth herein. Rather, these embodiments are provided so that this disclosure will satisfy applicable legal requirements.

As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. Thus, use of any such aforementioned terms, or similarly interchangeable terms, should not be taken to limit the spirit and scope of embodiments of the present invention.

The figures are not drawn to scale and are provided merely to illustrate some example embodiments of the inventions described herein. The figures do not limit the scope of the present disclosure or the appended claims. Several aspects of the example embodiments are described below with reference to example applications for illustration. It should be understood that numerous specific details, relationships, and methods are set forth to provide a full understanding of the example embodiments. One having ordinary skill in the relevant art, however, will readily recognize that the example embodiments can be practiced without one or more of the specific details or with other methods. In other instances, well-known structures and/or operations are not shown in detail to avoid obscuring the example embodiments.

The present disclosure relates to feeding geometries associated with firearm barrels and related firearms, assemblies, components, and methods that may provide both strength and support for the cartridge during firing while also exhibiting improved feeding during cycling. Example embodiments include a barrel having one or more barrel feed ramps for facilitating smoother feeding of the cartridges into the chamber. In contrast to barrels using a chamfered transition or other symmetrical transition, a barrel feed ramp or ramps may facilitate better feeding at the positions necessary for guiding the cartridge into the chamber, while the transition between a chamber end surface and an inner surface at the chamber may be sharper and more supportive of the cartridge in other circumferential positions. This benefit may be achieved, in some example embodiments, because the transition at the chamber end need not be sufficiently gradual to accommodate cartridge feeding at all circumferential positions (e.g., a sharper edge with more support may be used at non-feeding locations). In some embodiments, the one or more barrel feed ramps may be cut into the barrel while the barrel extension is attached to ensure proper rotational alignment.

With reference to FIG. 1, a firearm is shown in which the barrels and barrel assemblies for supporting, guiding, and positioning one or more cartridges (labeled in FIG. 2) from a magazine 406 relative to a firearm 10 may be implemented. Example embodiments of the present disclosure may include a barrel 12 and a firearm comprising the barrel 12 and one or more of an upper receiver 14; a lower receiver assembly 100; a magazine 406; a grip 110; a trigger guard 102; an action, including a bolt carrier group (e.g., bolt, firing pin, ejector, etc.) (shown in FIG. 2); an autoloading system (e.g., gas driven system (gas direct gas impingement, gas piston, etc.), recoil-driven autoloader, inertia-driven autoloader, etc.), buttstock 16, magazine catch 18, and/or other firearm components that would be appreciated in light of the present disclosure.

With reference to FIG. 2, according to some embodiments, a magazine 406 may be held in a magazine well 112 (labeled in FIG. 2) defined by a lower receiver 106 of the firearm. The magazines 406 and the magazine well 112 may include a clearance that may allow the magazine to drop free when released while also holding the magazine in a stable position. This stable positioning may allow a cartridge 24 to be stripped from the top of the magazine by a bolt 22 and fed forward and upward into the chamber 26 of the barrel 12 as the firearm cycles. The bolt 22 may then lock with a barrel extension 28 to hold the cartridge 24 in place. The bolt lugs 22A interface with the locking lugs 306 of barrel extension 28 to lock the bolt 22, for example, by inserting the bolt lugs 22A between the barrel extension locking lugs 306 and rotating the bolt 22 to impinge the rear of the bolt lugs 22A on the inner, forward surface of the barrel extension locking lugs 306. The inner surface 30 of the barrel 12 at the chamber 26 may support the cartridge casing during ignition of the cartridge propellent, preventing the cartridge casing from deforming, splitting, or otherwise misfiring during the increase in internal pressure and facilitating direction of the expanding gases behind the bullet to propel the bullet down the bore of the barrel.

The magazine 406 may be configured to stagger the cartridges 24 left-to-right, so that the cartridges are fed into the chamber 26 from slightly left of the center longitudinal axis of the firearm (e.g., left of longitudinal axis 303 shown in FIGS. 3, 4B, 5A, 6B, 7A) and slightly right of the center longitudinal axis of the firearm in an alternating manner.

In some embodiments (e.g., an AR-15® platform), the barrel of the firearm may define a chamber end surface at a distal end of the barrel (e.g., chamber end surface 308 shown in FIGS. 3-6B) and an inner surface 30 defining the bore of the barrel, including the chamber 26. A transition 302 may be defined as a region of intersection between the chamber end surface 308 and the inner surface 30. The transition 302 may be configured, for example, with various contours and shapes which may be configured to support the rearmost edge of a cartridge 24 (see FIG. 6B) while also guiding the cartridge into the chamber 26. As described herein, the transition 302 may be configured with one or more barrel feed ramps (e.g., barrel feed ramps 310 shown in FIGS. 3-6B), which may provide an angled surface for feeding the cartridge into the chamber without jamming. The barrel feed ramp(s) 310 may define a more gradual portion of the transition 302 (e.g., extending further into the chamber 26 and/or further radially outward along the chamber end surface 308) than the remaining circumferential portions of the transition, which remaining portions may be configured to provide additional support to the cartridge. As discussed herein, this asymmetrical (e.g., radially asymmetrical relative to the circumference of the transition) transition may provide improved feeding and improved support for the cartridge.

Cartridges that are insufficiently supported (e.g., by a more gradual transition) may cause damage (e.g., splitting, cracking, head separation, etc.) of the casing or other deformations that may result in firearm malfunctions. For example, an insufficiently-supported portion of the casing may expand around the chamber end of the barrel, thus causing the casing to become difficult to extract from the chamber or eject from the firearm. An insufficiently-supported portion of the casing may break open (e.g., split, crack, etc.), thus allowing the expanding gases to escape out the chamber end of the barrel leading to damage to the firearm (e.g., broken ejector, bullet lodged in the bore of the barrel, etc.) or injury to the operator. If there is a pressure overload condition (e.g., too much powder in the cartridge, a blocked barrel by mud or a squib round) any insufficiently-supported section of the cartridge case can blow out and release high pressure gas into the bolt, bolt carrier and upper receiver area. These parts will may then catastrophically fail.

Barrels with insufficient feeding surfaces may cause the bullet of the cartridge to catch on the chamber end surface 308 when feeding the cartridge into the chamber 30. The solutions of the present disclosure may include structures for the chamber end of the barrel 12 of a firearm 10 that provide improved feeding and support for the cartridge.

With reference to FIG. 2, a cross-section of a portion of the firearm 10 is shown, in various embodiments, the barrel 12 comprises a muzzle end 12A and a chamber end 12B that may attach to a barrel extension 28 attached to the upper receiver 14. The barrel extension 28 and the chamber end 12B of the barrel 12 may be connected via barrel interface surfaces 28B (e.g., threading labeled in FIGS. 3-4B). In some embodiments, the outer surface of the barrel 12 and inner surface of the barrel extension 28 may have complementary surfaces, such as threading, for engaging the components. The barrel 12 and barrel extension 28 may be held together by a fastener 28A (e.g., a set screw, etc.).

The depicted firearm 10 includes a bolt carrier group 20 and a bolt 22 configured to strip a cartridge 24 from the magazine 406 and feed the cartridge into the chamber 26 of the chamber end 12B of the barrel 12 for firing. The cartridge 24 may be retained in the chamber 26 by a taper (e.g., taper 26A labeled in FIGS. 4B and 7C) in the inner surface 30 of the barrel 12 at the front end and by the bolt 22 at the rear end, with the chamber 26 providing support for the casing. Firing of cartridge 24 occurs during actuation of trigger 34 while the bolt carrier group 20 is in the forward position (toward the left of FIG. 2), and the bolt lugs 22A are engaged with the barrel extension lugs 306. Actuation of trigger 34 causes disconnector 35 to release hammer 36. The firing pin 38 is driven toward the primer of cartridge 24 when the firing pin 38 is struck by hammer 36, thus firing the chambered cartridge 24. Gas delivery system 32 directs at least some of the expanding gases generated by firing the chambered cartridge 24 from a location at or near the muzzle end to at least force the bolt carrier group 20 rearward (toward the right of FIG. 2) causing disconnection of the lugs, extraction of the spent cartridge casing from chamber 26, and resetting the trigger assembly components (e.g., hammer 26, disconnector 35, trigger 34, and other trigger components known in the art). Various embodiments of the present disclosure provide for structures that facilitate smooth feeding of the cartridge 24 from the magazine 406 to the chamber 26. Moreover, various embodiments of the present disclosure provide for structures that facilitate supporting the rearward portion of the casing of the cartridge 24 during firing of the firearm to improve cycling of the firearm during operation (e.g., propelling the bullet, cycling the bolt carrier group 20, ejecting the spent casing, etc.).

FIG. 3 depicts a cross-sectional view of a portion of a barrel, according to some example embodiments. In the depicted embodiment, the depicted chamber end 12B of barrel 12 comprises the chamber end surface 308 defining the distal end of the barrel, the barrel interface surface 28B, the inner surface 30 defining the bore 12C and the chamber 26, the barrel feed ramps 310, and the transition 302. The barrel 12 defines a longitudinal axis 303 along the length of the barrel 12. The transition 302 includes barrel feed ramps 310 and a remaining transition region 302A without the feed ramps, with the transition defining the intersection between the depicted chamber end surface 308, which is planar or substantially planar and perpendicular to the longitudinal axis 303 in the depicted embodiment, and the inner surface 30, which is cylindrical or substantially cylindrical (e.g., slightly conical). The depicted remaining transition region 302A is shown having a much shorter transition (e.g., shorter radially and/or axially) at all circumferential positions around the rearward all circumference of chamber 26 other than those circumferential positions covered by the barrel feed ramps 310. In some embodiments, the remaining transition region 302A may be a substantially right angle. As used herein, the term "substantially right angle" may refer to an edge that is sanded or deburred in accordance with known manufacturing processes but excludes chamfers, fillets, and other artificial contours. In some embodiments, the remaining transition 302A may define at least some lead in angle having an extent which is less than the barrel feed ramps. In some embodiments, the remaining transition 302A, may define less of a lead in angle than would be required to direct a cartridge into the chamber. For example, the remaining transition 302A may define a sharper transition (e.g., a lesser chamfer, edge, or other lead in angle, which may extend a shorter distance into the chamber) than an existing firearm barrel (e.g., an M4/AR15 barrel) without barrel extensions. In some embodiments, the transition 302 at the remaining transition region 302A may define a more rapid transition from the chamber end surface 308 to the inner surface 30 forming the chamber 26 than the portions of the transition 302 defining the barrel feed ramps 310 (e.g., the barrel feed ramps 310 may extend longitudinally farther into the chamber 26 and/or radially farther outward along the chamber end surface 308 than the remaining transition region 302A). In some embodiments, the remaining transition region 302 may not provide a sufficiently gradual transition to allow feeding of a cartridge outside the barrel feed ramps 310. In various embodiments, the transition 302 may be circumferentially asymmetrical (e.g., the transition 302 at the barrel feed ramps may define a different shape than the remaining transition region 302A), such that the chamber is configured to provide a greater axial length of contact with the cartridge at circumferential positions that do not include the one or more barrel feed ramps than at circumferential positions that include the one or more barrel feed ramps. For example, the inner surface 30 of the chamber 26 may extend farther rearward towards the chamber end surface 308 at the remaining transition region 302A than at the position of the barrel feed ramps 310.

The transition 302 may be configured with at least the barrel feed ramps 310 to facilitate guidance of a cartridge 24 from magazine 406 into a firing position in the chamber 26 during firearm operational cycles. The barrel feed ramps 310 of transition 302 may be configured to at least partially facilitate orienting and guiding the cartridge 24 into chamber 26 by directing the bullet tip of the cartridge 24 upward and/or laterally from the top of magazine 406 toward the longitudinal axis 303. By providing the transition 302 between the chamber end surface 308 and the inner surface 30, the barrel feed ramps 310 reduce the likelihood that cartridge 24 will be driven into and jammed by surfaces around the chamber 26 instead of feeding smoothly into the chamber 26 during firing cycles. The barrel feed ramps 310 may further provide clearance for the body of cartridge 24 to tilt inward toward the front of chamber 26 (toward the right side of FIG. 3), once the body of the cartridge 24 is fed fully from the magazine 406 by at least the bolt 22.

With continued reference to FIG. 3, the transition 302 may be configured with at least some portions around the rearward circumference of chamber 26 (e.g., the remaining transition region 302A) that allow the inner surface 30 to extend further distally for additional support (e.g., via a sharper transition, such as a substantially right angle or otherwise less of a lead in angle than would be required to direct a cartridge into the chamber) at positions other than those circumferential positions associated with the barrel feed ramps 310. The remaining transition region 302A may be configured to allow the inner surface 30 of the chamber 26 to better support the casing of cartridge 24 during firing of cartridge 24. By supporting the casing of cartridge 24 during firing the geometries of the transition 302 may reduce deformation (e.g., bulging, cracking, splitting, etc.) of the cartridge casing and thus increase the reliability of firearm 10.

In accordance with various embodiments, the one or more barrel feed ramps (e.g., barrel feed ramps 310, 310A shown in FIGS. 3-7B) extend axially into the chamber 26 farther from the chamber end surface 308 than the transition 302 in at least one other circumferential position (e.g., the remaining transition region 302A) that lacks the one or more barrel feed ramps. The one or more barrel feed ramps 310, 310 may thus define a more gradual transition from the chamber end surface to the inner surface at the chamber than the transition at the remaining transition region 302A. At least one of the one or more barrel feed ramps 310, 310A extends radially farther from the longitudinal axis 303 of the barrel along the chamber end surface 308 than the transition in at least one other circumferential position (e.g., the remaining transition region 302A).

In various embodiments, the chamber end surface 308 is perpendicular or substantially perpendicular to the inner surface 30 at the chamber 26. The one or more barrel feed ramps 310, 310A may define at least one intermediate angle between an angle of the chamber end surface 308 and the longitudinal axis 303 of the barrel relative to a plane defined in part by the longitudinal axis (e.g., a plane of the paper in FIGS. 3, 4B, 6B, and 7A). For example, the intermediate angle may be defined at or about 120 degrees from the longitudinal axis.

FIG. 4A is a side view of a barrel assembly 11, according to some example embodiments. The barrel assembly may include at least the barrel 12 and a barrel extension 28. FIG. 4B is a cross-sectional view of a portion of the barrel assembly 11 of FIG. 4A. The portion of barrel 12 shown in FIG. 4B comprises the chamber end 12B of barrel 12 including the chamber 26 and a portion of the bore 12C. The chamber end 12B of barrel 12 is attached to the barrel extension 28 by way of the barrel interface surfaces 28B. The barrel interface surfaces 28B may comprise complementary threads of the barrel 12 and the barrel extension 28. The barrel extension 28 may include locking lugs 306 and barrel extension feed ramps 304. The locking lugs 306 may be configured to engage corresponding lugs on the bolt 22 to secure the bolt during firing.

The barrel extension feed ramps 304 may be configured to align with the barrel feed ramps 310 of transition 302 of the barrel 12, such that at least one feed path may be defined between the barrel extension 28 and the barrel 12 by each pair of the corresponding feed ramps 304, 310. In some embodiments, the barrel extension feed ramps 304 may be used as respective points of reference to manufacture the barrel feed ramps 310 into barrel 12, such as by aligning a drill tip with a center point associated with one or more radii of the barrel extension feed ramps 304. In some embodiments, the feed ramps 304, 310 may be manufactured by removing material from each of the barrel extension 28 and barrel 12 while the two are affixed to each other to ensure proper alignment. The barrel extension feed ramps 304 may be configured to direct the tip of cartridge 24 toward the barrel feed ramps 310.

FIG. 5A is distal end view of a barrel assembly illustrating a longitudinal axis view down the bore of the barrel 12. In the depicted embodiment, two barrel feed ramps 310 are shown slightly left of the center longitudinal axis of the firearm (e.g., left of longitudinal axis 303 shown in FIGS. 3, 4B, 5A, 6B, 7A) and slightly right of the center longitudinal axis of the firearm, which may correspond to the positions that the cartridges are alternatingly fed from the magazine (e.g., the barrel feed ramps 310 may be spaced 22.5 degrees circumferentially about the longitudinal axis from each other). In the embodiment of FIG. 5A, the barrel feed ramps 310 are depicted having a semicylindrical contour oriented at an angle relative to the longitudinal axis. In some embodiments, the semicylindrical contour need not define a perfect half-cylinder and the semicylindrical contour may include, for example, any partially cylindrical shape. In some embodiments, the barrel feed ramps may be any contour (e.g., in the longitudinal, circumferential, and/or radial directions) capable of functioning according to the embodiments described herein. The barrel feed ramps 310 are included as part of the transition 302 and are formed as recesses at the intersection between the chamber end surface 308 and the inner surface 30 of the barrel 12 at the chamber end 12B. With continued reference to FIG. 5A, the barrel feed ramps 310 are each angled towards a plane defined between the two barrel feed ramps (e.g., the vertical axis shown in FIG. 5A). The depicted plane is defined by and intersects the longitudinal axis of the barrel. As also depicted in FIG. 5A, the wall of the barrel is thinner in at least a location of the one or more barrel feed ramps 310 than in other locations at the chamber end 12B.

FIG. 5B is a side isometric view of the barrel assembly of FIG. 5A with an illustrative cutout 802 through a portion of barrel extension 28 to show an isometric view of barrel feed ramps 310 therein. FIG. 5A and FIG. 5B illustrate that the barrel extension feed ramps 304 may be configured to align with the barrel feed ramps 310 of transition 302 of the barrel 12. For example, circumference and projected center point D for the rightward most barrel feed ramp 310 may generally align with one or more features associated with the rightward-most (toward the right side of FIG. 5B) barrel extension feed ramp 304 (e.g., the corresponding feed ramps may or may not have the same degree(s) of incline and, in either instance, the corresponding feed ramps may be circumferentially aligned about the longitudinal axis 303 such that the cartridge feeds smoothly between the two). One or more of the barrel feed ramps 310 and/or the barrel extension feed ramps 304 may be at least partially aligned with one or more of the spaces between locking lugs 306 of barrel extension 28, as show in FIG. 5A with respect to alignment axis E. As also depicted in FIGS. 5A-5C, each of the barrel feed ramps 304, 310 may be oriented at least partially towards the longitudinal axis 303 and at least partially towards the muzzle end 12A (e.g., the incline of the barrel feed ramps 304, 310 may be oriented forward towards the muzzle end 12A and radially inwardly such that the cartridge 24 is directed towards the longitudinal axis regardless of which (in instances having more than one feed ramp) of the barrel feed ramps 310 or barrel extension feed ramps 304 are engaged. For example, projected centerline D of the rightmost barrel feed ramp 310 in FIG. 5B intersects the longitudinal axis 303 forward (e.g., towards the muzzle end along the longitudinal axis) of the barrel feed ramps. FIG. 5C is a side isometric view of the barrel assembly of FIG. 5A and FIG. 5B. FIG. 5C shows a cartridge 24 inserted into the chamber 26 of barrel 12, with the remaining transition 302A facilitating support of the rear of the cartridge 24 while the barrel feed ramps 310 are visible.

FIG. 6A is a top-down view of a barrel assembly 11 according to some example embodiments. The depicted barrel assembly 11 comprises at least barrel 12 and barrel extension 28. FIG. 6B is a cross-sectional side view of a portion of the barrel assembly of FIG. 6A. The portion of barrel 12 shown in FIG. 6B comprises the muzzle end 12A, the chamber end 12B including the chamber 26, a portion of the bore 12C, and the longitudinal axis 303. The chamber 26 is shown occupied by cartridge 24. The transition 302, as shown, supports the rearward portion of cartridge 24. The depicted transition 302 is configured to at least partially supports the rearward circumference of the casing of cartridge 24.

Turning to FIGS. 7A-7C, an embodiment of the one or more barrel feed ramps is shown in which a larger barrel feed ramp 310A replaces the depicted semicylindrical barrel feed ramps 310 of FIGS. 3-6B, although the barrel feed ramps 310 of FIGS. 3-6B are not required to be semicylindrical. Except as otherwise stated, the larger barrel feed ramp 310A may function and may be structured in accordance with any embodiment described herein.

With reference to FIGS. 7B-7C, the larger barrel feed ramp 310A may be defined by a recess in the transition 302 formed, for example, by removing material at the intersection of the chamber end surface 308 and the inner surface 30 to form a gradual transition, consistent with any embodiment of a barrel feed ramp discussed herein. As depicted, the larger barrel feed ramp 310A may be configured to engage cartridges from multiple directions, including cartridges fed through either of the depicted barrel extension feed ramps 304. Said differently, the depicted larger barrel feed ramp 310A aligns circumferentially with both depicted barrel extension feed ramps 304. In the depicted embodiment, cartridges fed from either side of the magazine may engage the same larger barrel feed ramp 310A, while the remaining transition region 302A provides additional support for the cartridge and the transition 302 is asymmetrical as with the various embodiments described herein.

During manufacturing, the barrel feed ramps 310, 310A described herein may be manufactured by removing material from the barrel at the intersection of the chamber end surface 308 and the inner surface 30 of the barrel 12. The material may be removed, for example, by milling, drilling, Electrical Discharge Machining (EDM), cutting, grinding, reaming, or by any other method known in the art. The EDM processes may include without limitation one or more of die-sinking or ram EDM, wire or wire cutting EDM, or other electrical discharge methods known in the art. In some embodiments, an endmill may be used to mill away material from at least the barrel using a five axis milling machine. To facilitate alignment of the barrel feed ramps 310, 310A with the components of the firearm, including the barrel extension 28 and magazine 406, the barrel feed ramps may be formed in the barrel while the barrel extension is attached. For example, a method of manufacturing the barrel assembly may comprise first attaching the barrel 12 to the barrel extension 28 (e.g., via any method, such as fasteners 28A and/or barrel interface surfaces 28B) before then removing material from at least the barrel to define the one or more barrel feed ramps 310, 310A at the chamber end 12B while the barrel and barrel extension are attached. By way of example, the barrel feed ramps 310, 310A may be formed by drilling or milling in direction D shown in FIG. 5B.

In some embodiments, the barrels 12 and barrel assemblies 11 discussed herein may be used as part of a new firearm or as replacement parts for an existing firearm. The barrels 12 and barrel assemblies 11 may be configured to fit within a standard platform (e.g., an AR-15® platform) without otherwise modifying the platform.

The embodiments described herein may also be scalable to accommodate at least the aforementioned applications. Various components of embodiments described herein can be added, removed, reorganized, modified, duplicated, and/or the like as one skilled in the art would find convenient and/or necessary to implement a particular application in conjunction with the teachings of the present disclosure. Moreover, specialized features, characteristics, materials, components, and/or equipment may be applied in conjunction with the teachings of the present disclosure as one skilled in the art would find convenient and/or necessary to implement a particular application in light of the present disclosure.

Many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

The invention claimed is:

1. A barrel assembly of a firearm, comprising:

a barrel; and a barrel extension configured to attach to the barrel, wherein the barrel comprises an inner surface defining a bore configured to guide a projectile as the projectile is propelled through the bore by pressurized gas, the barrel defining:

a muzzle end;

a chamber end opposite the muzzle end, wherein the inner surface defines a chamber at the chamber end, wherein the chamber is configured to receive a cartridge and to support at least a portion of a casing of the cartridge during firing; and a longitudinal axis extending between the muzzle end and the chamber end, wherein the barrel further defines one or more barrel feed ramps at the chamber end configured to guide at least a portion of the cartridge into the chamber during an operational cycle of the firearm, wherein the one or more barrel feed ramps comprises a plurality of barrel feed ramps, and wherein each barrel feed ramp of the plurality of barrel feed ramps is oriented at least partially towards the longitudinal axis of the barrel and at least partially towards the muzzle end.

2. The barrel assembly of claim 1, wherein the barrel defines a barrel extension interface comprising one or more engagement features, and wherein the barrel extension defines a complementary barrel extension interface comprising one or more complementary engagement features.

3. The barrel assembly of claim 2, wherein the one or more engagement features are configured to engage the one or more complementary engagement features to securely engage the barrel and the barrel extension.

4. The barrel assembly of claim 1, wherein the barrel further defines a chamber end surface defining an end of the barrel at the chamber end, the chamber end surface being connected to the inner surface of the barrel via a transition, wherein the one or more barrel feed ramps are formed in the chamber end surface and the inner surface of the barrel at the chamber end.

5. The barrel assembly of claim 4, wherein the one or more barrel feed ramps define at least one recess formed at least at the transition between the chamber end surface and the inner surface of the barrel.

6. The barrel assembly of claim 5, wherein the one or more barrel feed ramps extends axially into the chamber farther from the chamber end surface than the transition in at least one other circumferential position that lacks the one or more barrel feed ramps, such that the one or more barrel feed ramps define a more gradual transition from the chamber end surface to the inner surface at the chamber than the transition at the at least one other circumferential position.

7. The barrel assembly of claim 5, wherein at least one of the one or more barrel feed ramps extends radially farther from the longitudinal axis of the barrel along the chamber end surface than the transition in at least one other circumferential position that lacks the one or more barrel feed ramps.

8. The barrel assembly of claim 5, wherein the chamber end surface is perpendicular or substantially perpendicular to the inner surface at the chamber, and wherein the transition between the chamber end surface and the inner surface of the barrel defines a substantially right angle at circumferential positions other than circumferential positions of the one or more feed ramps.

9. The barrel assembly of claim 4, wherein the transition is circumferentially asymmetrical such that the chamber is configured to provide a greater axial length of contact with the cartridge at circumferential positions that do not include the one or more barrel feed ramps than at circumferential positions that include the one or more barrel feed ramps.

10. The barrel assembly of claim 9, wherein the inner surface of the chamber extends farther rearward towards the chamber end surface at the circumferential positions that do not include the one or more barrel feed ramps than at the circumferential positions that include the one or more barrel feed ramps.

11. The barrel assembly of claim 4, wherein the one or more barrel feed ramps define at least one intermediate angle between an angle of the chamber end surface and the longitudinal axis of the barrel relative to a plane defined in part by the longitudinal axis.

12. The barrel assembly of claim 1, wherein a wall of the barrel is thinner in at least a location of the one or more barrel feed ramps than in other locations at the chamber end.

13. The barrel assembly of claim 1, wherein each of the one or more barrel feed ramps define a semicylindrical contour oriented at an angle relative to the longitudinal axis.

14. The barrel assembly of claim 1, wherein the plurality of barrel feed ramps comprises two barrel feed ramps, and wherein each barrel feed ramp is angled towards a plane defined between the two barrel feed ramps, and wherein the plane is defined in part by the longitudinal axis.

15. The barrel assembly of claim 14, wherein a first barrel feed ramp and a second barrel feed ramp are positioned adjacent to each other to engage staggered cartridges from within a magazine that are fed from alternating sides of the magazine, such that the first barrel feed ramp and the second barrel feed ramp are configured to alternatingly engage the staggered cartridges.

16. The barrel assembly of claim 1, wherein the one or more barrel feed ramps are manufactured by removing material from the barrel.

17. The barrel assembly of claim 1, wherein the barrel extension comprises one or more locking lugs.

18. The barrel assembly of claim 1, wherein one or more barrel extension feed ramps configured to align circumferentially relative to the one or more barrel feed ramps.

19. The barrel assembly of claim 1, wherein the barrel comprises two feed ramps, and the barrel extension comprises two barrel extension feed ramps.

20. A firearm comprising:

a barrel assembly comprising:

a barrel; and a barrel extension configured to attach to the barrel, the barrel comprising an inner surface defining a bore configured to guide a projectile as the projectile is propelled through the bore by pressurized gas, the barrel defining:

a muzzle end;

a chamber end opposite the muzzle end, wherein the inner surface defines a chamber at the chamber end, wherein the chamber is configured to receive a cartridge and to support at least a portion of a casing of the cartridge during firing; and a longitudinal axis extending between the muzzle end and the chamber end, wherein the barrel further defines one or more barrel feed ramps at the chamber end configured to guide at least a portion of the cartridge into the chamber during an operational cycle of the firearm, wherein the one or more barrel feed ramps comprises a plurality of barrel feed ramps, and wherein each barrel feed ramp of the plurality of barrel feed ramps is oriented at least partially towards the longitudinal axis of the barrel and at least partially towards the muzzle end.

21. The firearm of claim 20, further comprising:

a bolt defining one or more bolt lugs;

a bolt carrier group comprising a bolt carrier, a firing pin, and an ejector; and a trigger assembly comprising a trigger, a hammer, and a disconnector.

22. A method of manufacturing at least a portion of a barrel assembly of a firearm; the barrel assembly comprising a barrel and a barrel extension; the barrel comprising an inner surface defining a bore configured to guide a projectile as the projectile is propelled through the bore by pressurized gas; the barrel defining a muzzle end, a chamber end opposite the muzzle end, wherein the inner surface defines a chamber at the chamber end, wherein the chamber is configured to receive a cartridge and to support at least a portion of a casing of the cartridge during firing, and a longitudinal axis extending between the muzzle end and the chamber end; the method comprising:

attaching the barrel to a barrel extension; and removing material from at least the barrel to define one or more barrel feed ramps at the chamber end while the barrel and barrel extension are attached, wherein the barrel further defines one or more barrel feed ramps at the chamber end configured to guide at least a portion of the cartridge into the chamber during an operational cycle of the firearm, wherein the one or more barrel feed ramps comprises a plurality of barrel feed ramps, and wherein each barrel feed ramp of the plurality of barrel feed ramps is oriented at least partially towards the longitudinal axis of the barrel and at least partially towards the muzzle end.

23. A method of manufacturing a firearm, comprising:

performing the method of claim 22 to manufacture the barrel assembly; and connecting the barrel assembly directly or indirectly with at least a bolt carrier group, a trigger assembly, a receiver assembly, and a gas delivery system.

* * * * *